US005499174A

United States Patent [19]

Lin

[11] Patent Number: 5,499,174

[45] Date of Patent: Mar. 12, 1996

[54] DECORATIVE LAMP ASSEMBLY

[75] Inventor: Cheng-Yuan Lin, Hsin-Chu, Taiwan

[73] Assignee: Yuan Mei Decorative Lamp & Painting Co., Ltd., Hsin-Chu, Taiwan

[21] Appl. No.: 310,236

[22] Filed: Sep. 21, 1994

[51] Int. Cl.[6] ..... F21V 11/00

[52] U.S. Cl. ..... 362/353; 362/311; 362/363; 362/806

[58] Field of Search ..... 362/267, 226, 362/311, 353, 375, 363, 806

[56] References Cited

U.S. PATENT DOCUMENTS

| | | | |
|---|---|---|---|
| 2,347,055 | 4/1944 | Johnson | 240/41 |
| 2,481,054 | 9/1949 | Wendel | 240/26 |
| 2,709,217 | 5/1955 | McCluskey | 240/2 |
| 3,248,531 | 4/1966 | Dover | 240/8.3 |
| 3,763,367 | 10/1973 | Nitsch et al. | 240/7.1 R |
| 4,450,511 | 5/1984 | Micha | 362/267 |
| 4,521,836 | 6/1985 | Puttemanns et al. | 362/145 |
| 5,184,890 | 2/1993 | Chen et al. | 362/226 X |
| 5,361,192 | 11/1994 | Lai | 362/226 X |
| 5,414,605 | 5/1995 | Lin | 362/267 |

*Primary Examiner*—Stephen F. Husar
*Attorney, Agent, or Firm*—Seed and Berry

[57] ABSTRACT

A decorative lamp assembly includes a lamp holder which has a substantially cylindrical seat with an upper end, a lower end and an elongated cylindrical wall extending from the upper end to the lower end. A lamp is connected securely to the upper end of the cylindrical seat and has two electrical wires extending outwardly through the cylindrical seat. A lamp casing has a bottom access opening. A lamp-casing holder has a one-piece hollow body which includes an inner cylindrical wall that is sleeved rightly around the cylindrical seat, and an outer cylindrical wall that is concentric with the inner cylindrical wall an annular groove for receiving tightly the annular neck portion of the lamp casing when the lamp casing covers the lamp.

6 Claims, 4 Drawing Sheets

DECORATIVE LAMP ASSEMBLY

TECHNICAL FIELD OF THE INVENTION

This invention relates to a decorative lamp assembly, more particularly to an improved decorative lamp assembly having a simple structure so as to simplify its assembly and to lower the manufacturing cost thereof.

DESCRIPTION OF THE RELATED ART

Referring to FIGS. 1 and 1A, as provided in U.S. application Ser. No. 08/097,041, now U.S. Pat. No. 5,414,605, incorporated herein by reference, the applicant disclosed a decorative lamp assembly (L1) which includes a lamp holder 2, a lamp 22 mounted to the lamp holder 2, and a lampshade unit 3 for covering the lamp 22.

The lamp holder 2 has a vertical cylindrical housing 23 and a lamp seat 21. The cylindrical housing 23 is made of an insulating material and has an open top and a bottom wall. The lamp seat 21 is mounted securely on the bottom wall of the cylindrical housing 23 and defines an annular groove 24 with the cylindrical housing 23. The lamp 22 is fixed to an upper end portion of the lamp seat 21 and has two electrical wires 28 that extend through a wire passage of the lamp seat 21 and a bottom hole of the cylindrical housing 23. The lamp holder 2 further includes a waterproof cap 25 which is attached removably to a bottom end of the cylindrical housing 23 so as to cover the bottom hole of the cylindrical housing 23. The waterproof cap 25 has two holes 251 for the passage of the electrical wires 28.

The lampshade unit includes a generally cylindrical rubber seal 32 and a transparent lampshade 30. The cylindrical rubber seal 32 is retained securely in the annular groove 24, while the transparent lampshade 30 covers the lamp 22 and has an annular bottom flange 31 that is pushed or pulled forcibly to extend through and to engage an inward flange of the cylindrical rubber seal 32. Owing to such a tight connection between the elements of the decorative lamp (L1), the lamp 22 can be protected from rain when used outdoors such that the decorative lamp assembly (L1) can have a long service life.

A main drawback of the decorative lamp assembly (L1) is that the structure thereof is complicated such that the assembly of the decorative lamp assembly (L1) is difficult and inconvenient to conduct, thereby increasing the manufacturing cost.

SUMMARY OF THE INVENTION

Accordingly, the objective of the invention is to provide an improved decorative lamp assembly which has a simple structure compared to the conventional decorative lamp assembly so as to simplify its assembly and to lower the manufacturing cost thereof.

The decorative lamp assembly according to this invention includes a lamp holder which has a substantially cylindrical seat with an upper end, a lower end and an elongated cylindrical wall extending from the upper end to the lower end. A lamp is connected securely to the upper end of the cylindrical seat and has two electrical wires extending outwardly through the cylindrical seat. A lamp casing has a bottom access opening and an annular neck portion extending downwardly from the access opening. A lamp-casing holder has a one-piece hollow body which includes an inner cylindrical wall that is sleeved tightly around the cylindrical seat, and an outer cylindrical wall that is concentric with the inner cylindrical wall to confine with the inner cylindrical wall an annular groove for receiving tightly the annular neck portion of the lamp casing when the lamp casing covers the lamp.

The inner cylindrical wall of the lamp-casing holder has a top end, a bottom end and an intermediate portion between the top and bottom ends. The outer cylindrical wall of the lamp-casing holder has a lower end, which extends toward and which is connected integrally to the intermediate portion of the inner cylindrical wall, and an upper open end which extends upwardly of the top end of the inner cylindrical wall.

The lamp holder may have an annular flange extending radially and outwardly from the cylindrical wall of the cylindrical seat adjacent to the lower end of the cylindrical seat, while the bottom end of the inner cylindrical wall rests on the annular flange. In addition, the lamp holder may have a plurality of spaced engaging ribs which extend axially on the cylindrical wall of the cylindrical seat above the annular flange.

A waterproof cap may be attached removably to the lower end of the cylindrical seat and has a cylindrical wall, a top opening and a bottom wall. The cylindrical wall of the waterproof cap is formed with two opposite notches for the passage of the electrical wires of the lamp.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
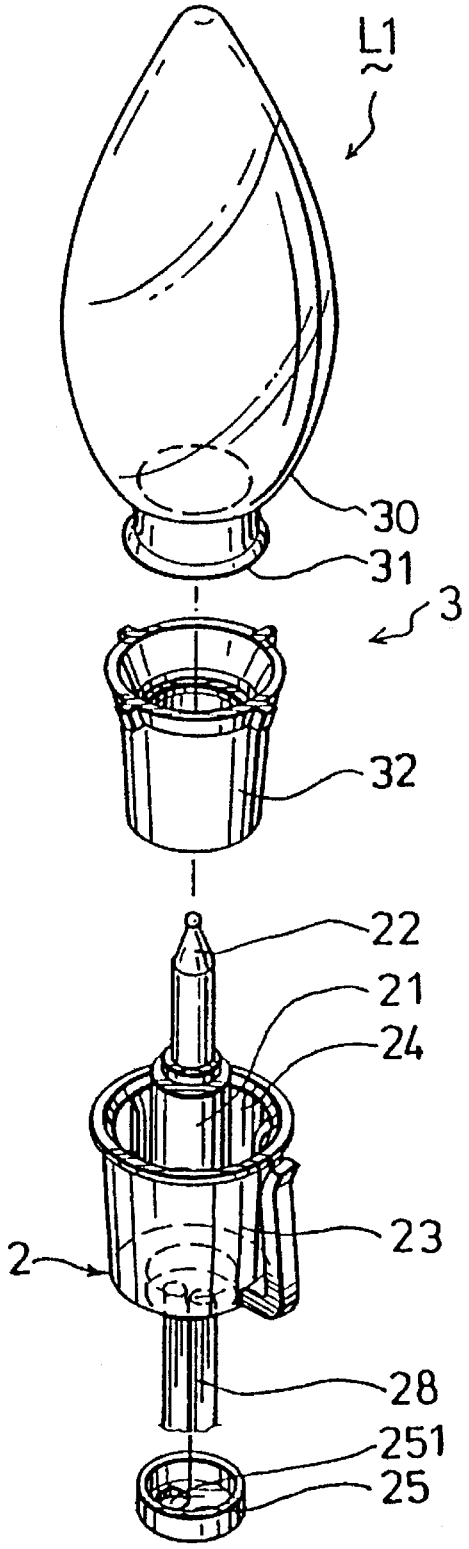
FIG. 1 is an exploded view of a conventional decorative lamp assembly.
Figure 1A:
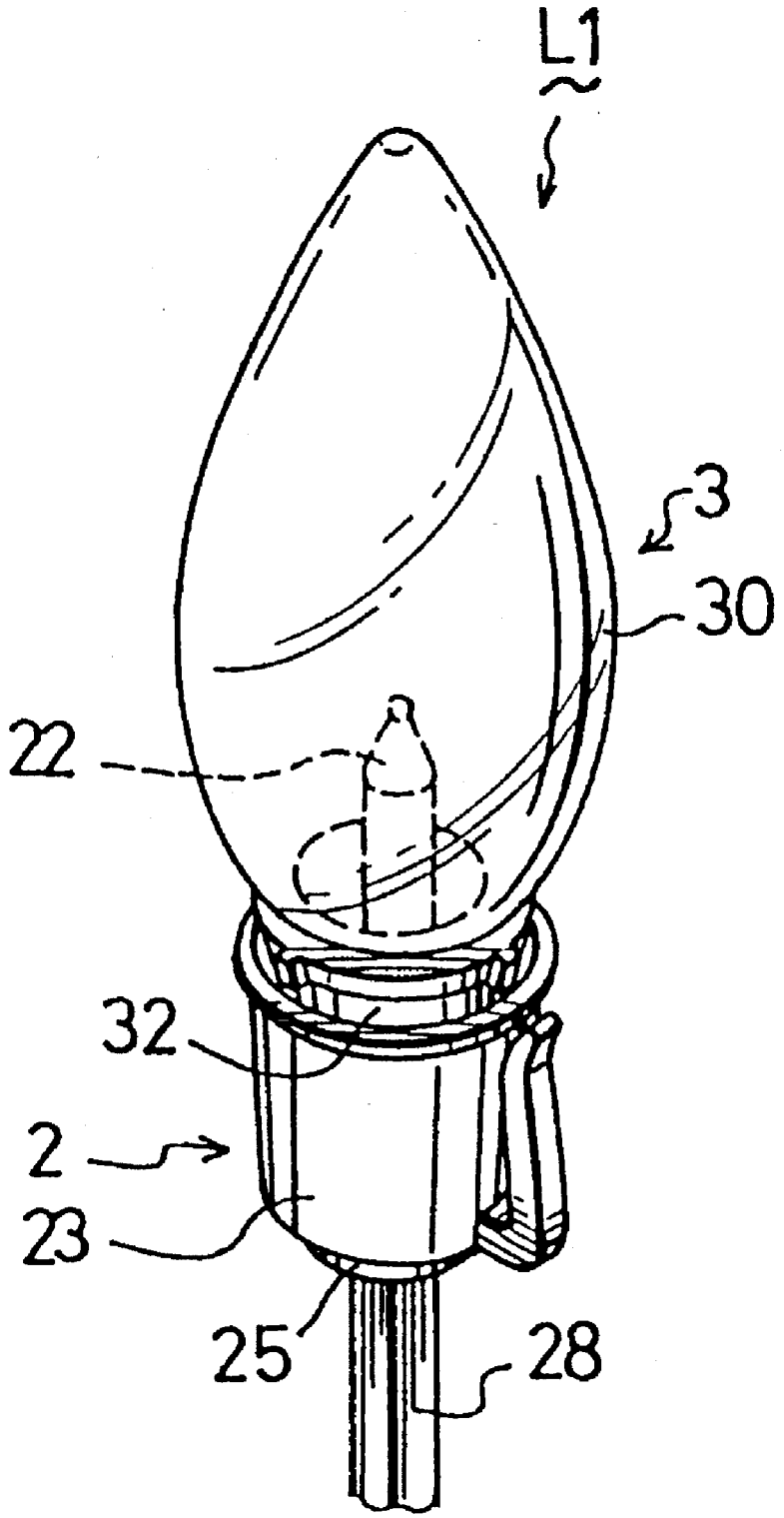
FIG. 1A is an assembled view of the conventional decorative lamp assembly shown in FIG. 1.
Figure 2:
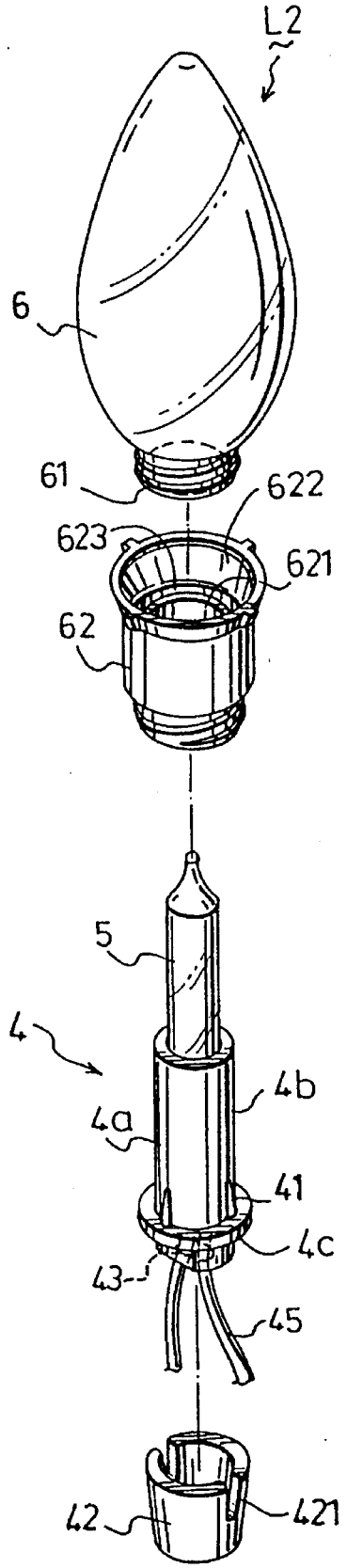
FIG. 2 is an exploded view of a decorative lamp assembly of this invention.
Figure 3:
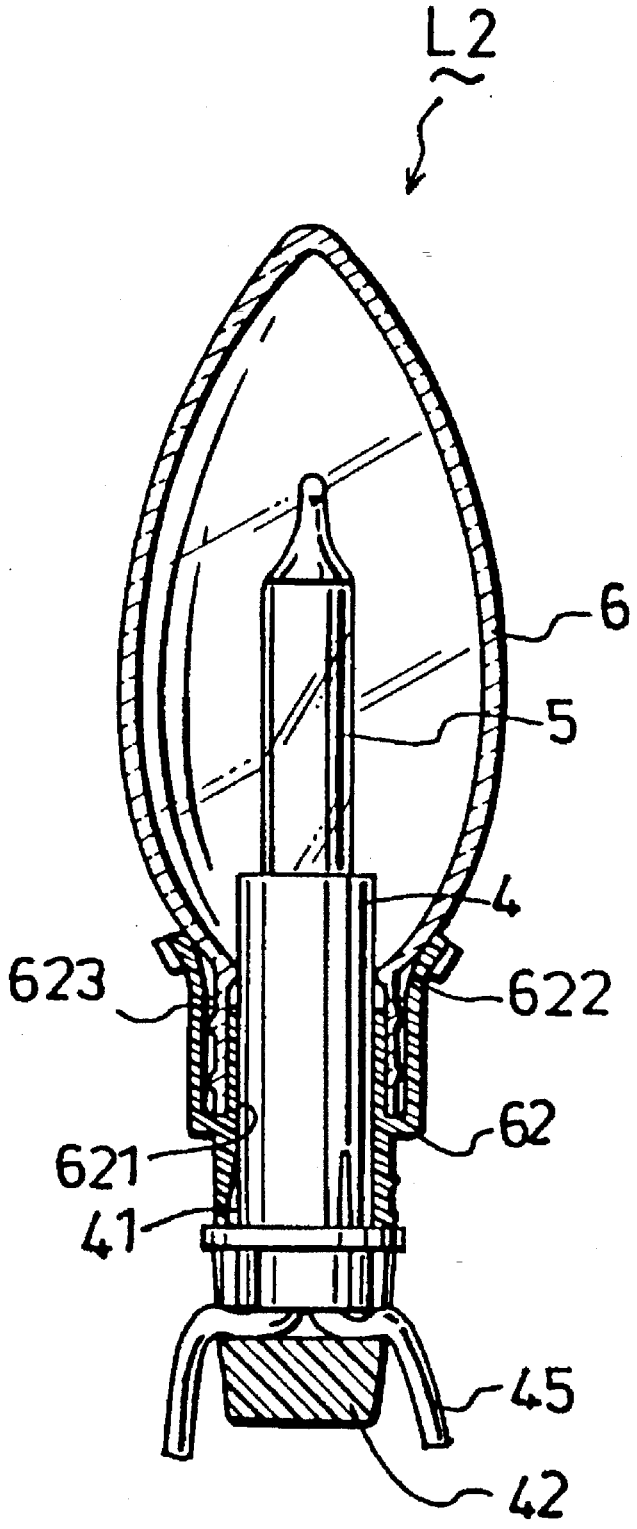
FIG. 3 is an assembled view of the decorative lamp assembly shown in FIG. 2.

Referring to FIGS. 2 and 3, a decorative lamp assembly (L2) according to this invention includes a lamp holder 4 which is made of an insulating material. The lamp holder 4 includes a substantially cylindrical seat (4*a*) which has an upper end, a lower end and an elongated end to the lower end. The lamp holder 4 further includes an annular flange (4*c*), which extends radially and outwardly from the cylindrical wall (4*b*) adjacent to the lower end of the cylindrical seat (4*a*), and three angularly spaced engaging ribs 41 extending axially on the cylindrical wall (4*b*) above the annular flange (4*c*).

A lamp 5 is connected securely to the upper end of the cylindrical seat (4*a*) and has two electrical wires 45 extending outwardly via a hole 43 in the lower end of the cylindrical seat (4*a*). A waterproof cap 42 is attached removably to the lower end of the cylindrical seat (4*a*) and has a cylindrical wall, a top opening and a bottom wall. The cylindrical wall of the waterproof cap 42 is formed with two opposite notches 421 for the passage of the electrical wires 45.

A transparent lamp casing 6 has a bottom access opening and an annular neck portion 61 extending downwardly from the access opening. A lamp-casing holder 62, which is made of a rubber material, has a one-piece hollow body which includes an inner cylindrical wall 621 that is sleeved tightly around the cylindrical seat (4*a*) and that has a top end, a bottom end and an intermediate portion between the top and bottom ends. The bottom end of the inner cylindrical wall 621 rests on the annular flange (4*c*) when the inner cylindrical wall 621 is sleeved around the cylindrical seat (4*a*). The one-piece hollow body of the lamp-casing holder 62 further includes an outer cylindrical wall 622 which is concentric with the inner cylindrical wall 621 to confine with the inner cylindrical wall 621 an annular groove 623 in order to receive tightly the annular neck portion 61 of the lamp casing 6. The outer cylindrical wall 622 has a lower end extending toward and connected integrally to the intermediate portion of the inner cylindrical wall 621, and an upper open end extending upwardly of the top end of the inner cylindrical wall 621.

It is noted that, the lamp holder 4 only includes the cylindrical seat (4*a*) with the annular flange (4*c*) rather than the housing 23 of the conventional decorative lamp assembly (L1). Thus, the manufacture of the lamp holder 4 is easier to accomplish than that of the conventional decorative lamp assembly (L1) such that the manufacturing cost of the decorative lamp assembly (L2) is lower compared to the conventional decorative lamp assembly (L1).

Since the decorative lamp assembly (L2) has a simple structure, the assembly of the decorative lamp assembly (L2) is easier to construct compared to the conventional decorative lamp assembly (L1). Referring to FIG. 3, when assembling the decorative lamp assembly (L2), the inner cylindrical wall 621 of the lamp-casing holder 62 is sleeved around the cylindrical seat (4*a*) above the annular flange (4*c*). The provision of the engaging ribs 41 can facilitate the tight engagement of the inner cylindrical wall 621 and the cylindrical seat (4*a*). The lamp casing 6 is secured to the lamp-casing holder 62 by pressing forcibly the annular neck portion 61 within the annular groove 623 between the inner and outer cylindrical walls 621, 622 such that the lamp casing 6 covers the lamp 5. The waterproof cap 42 is attached to the lower end of the cylindrical seat (4*a*) to permit the electrical wires 45 to extend through the notches 421.

When used outdoors, the decorative lamp assembly (L2) is generally hung invertedly. It is noted that the notches 421 of the waterproof cap 42 are formed in the cylindrical wall of the waterproof cap 42, unlike the conventional decorative lamp assembly (L1) in which the holder 251 of the waterproof cap 25 are formed in the bottom of the waterproof cap 25. Thus, the decorative lamp assembly (L2) can have a better waterproofing effect than the conventional decorative lamp assembly (L1).

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A decorative lamp assembly comprising:

a lamp holder including a substantially cylindrical seat having an upper end, a lower end and an elongated cylindrical wall extending from said upper end to said lower end;

a lamp connected securely to said upper end of said cylindrical seat and having two electrical wires extending outwardly through said cylindrical seat;

a lamp casing having a bottom access opening and an annular neck portion extending downwardly from said access opening; and a lamp-casing holder having a one-piece hollow body which includes an inner cylindrical wall that is sleeved tightly around said cylindrical seat, and an outer cylindrical wall that is concentric with said inner cylindrical wall to confine with said inner cylindrical wall an annular groove for receiving tightly said annular neck portion of said lamp casing when said lamp casing covers said lamp.

2. A decorative lamp assembly as claimed in claim 1 wherein said inner cylindrical wall of said lamp-casing holder has a top end, a bottom end and an intermediate portion between said top and bottom ends, said outer cylindrical wall of said lamp-casing holder having a lower end, which extends toward and which is connected integrally to said intermediate portion of said inner cylindrical wall, and an upper open end which extends upwardly of said top end of said inner cylindrical wall.

3. A decorative lamp assembly as claimed in claim 2 wherein said hollow body of said lamp-casing holder is made of a rubber material.

4. A decorative lamp assembly as claimed in claim 2 wherein said lamp holder has an annular flange extending radially and outwardly from said cylindrical wall of said cylindrical seat adjacent to said lower end of said cylindrical seat, said bottom end of said inner cylindrical wall resting on said annular flange.

5. A decorative lamp assembly as claimed in claim 4 wherein said lamp holder has a plurality of spaced engaging ribs extending axially on said cylindrical wall of said cylindrical seat above said annular flange.

6. A decorative lamp assembly as claimed in claim 1, further comprising a waterproof cap which is attached removably to said lower end of said cylindrical seat and which has a cylindrical wall, a top opening and a bottom wall, said cylindrical wall of said waterproof cap being formed with two opposite notches for passage of said electrical wires.

* * * * *